US009591881B1

(12) United States Patent
Sarkissian

(10) Patent No.: US 9,591,881 B1
(45) Date of Patent: Mar. 14, 2017

(54) DECORATIVE ORNAMENT REMOVABLY AFFIXED TO WEARING APPAREL

(71) Applicant: Lala Sarkissian, Woodland Hills, CA (US)

(72) Inventor: Lala Sarkissian, Woodland Hills, CA (US)

( * ) Notice: Subject to any disclaimer, the term of this patent is extended or adjusted under 35 U.S.C. 154(b) by 212 days.

(21) Appl. No.: 14/473,895

(22) Filed: Aug. 29, 2014

(51) Int. Cl.
*A41D 19/00* (2006.01)
*A41D 27/08* (2006.01)

(52) U.S. Cl.
CPC ..... *A41D 19/0051* (2013.01); *A41D 19/001* (2013.01); *A41D 27/08* (2013.01)

(58) Field of Classification Search
CPC ..... A41D 19/001; A41D 19/0013; A41D 19/0024; A41D 19/0051; A41D 27/08; A41D 19/0006; A44B 1/30; A44B 1/04; A44B 1/28; A44B 1/14; A44C 1/00; A44C 9/0053; A44C 15/001; A44C 17/0208; A44C 17/02; A44C 25/008; A44C 25/00; Y10T 24/1309; Y10T 24/1365
USPC ..... 2/159, 160, 244, 245, 164, 246, 265; 63/1.18, 20, 40; 24/6, 13, 105, 113 MP
See application file for complete search history.

(56) References Cited

U.S. PATENT DOCUMENTS 1,513,237 A * 10/1924 Green ..... A41D 19/0157 116/35 R
1,949,755 A 3/1934 Mitchell
2,128,640 A * 8/1938 Fenton ..... A44B 17/0005 411/365
2,287,865 A * 6/1942 Carleton ..... A44C 15/001 24/709.8
2,513,030 A * 6/1950 Lazarian ..... A41D 19/0013 2/159
2,667,004 A * 1/1954 Sanson ..... A44C 1/00 2/239
2,692,387 A * 10/1954 Spaniol ..... A41D 25/00 2/144
2,748,517 A * 6/1956 Berkis ..... A41D 27/08 2/75
4,007,515 A * 2/1977 Agnelli ..... A44B 1/34 24/103
4,507,344 A * 3/1985 Baughman ..... A44C 3/001 24/103
4,519,781 A 5/1985 Boyd
4,847,917 A 7/1989 Strongwater
4,975,986 A * 12/1990 Strongwater ..... A41D 19/0024 2/160
5,136,726 A 8/1992 Kellin
(Continued)

FOREIGN PATENT DOCUMENTS

GB 223429 10/1924
JP 09316714 A 12/1997

*Primary Examiner* — Amy Vanatta
(74) *Attorney, Agent, or Firm* — Thomas I. Rozsa

(57) ABSTRACT

A first mating fastening member embedded within a finger member of a glove so that a glove mating portion extends out of an exterior surface of a glove finger member and a mating ornament fastening member is either embodied into or extends out of a bottom of the ornament so that the ornament mating member is removably affixed to the glove mating portion to retain the ornament onto the glove finger member so that the ornament retention mechanism including the combination glove mating portion and ornament mating portion is concealed.

16 Claims, 5 Drawing Sheets

(56) References Cited

U.S. PATENT DOCUMENTS

| | | | | | |
|---|---|---|---|---|---|
| D375,397 | S * | 11/1996 | Morency | D2/614 | |
| 5,771,493 | A * | 6/1998 | Proctor | A42B 1/004 | 2/171.1 |
| 5,933,867 | A | 8/1999 | Corder | | |
| 6,058,573 | A * | 5/2000 | Silver | A41D 27/08 | 24/105 |
| 7,937,966 | B2 * | 5/2011 | Golove | A44C 9/00 | 63/29.1 |
| 8,062,087 | B1 | 11/2011 | Davis | | |
| D651,361 | S * | 12/2011 | Choi | D2/619 | |
| 2006/0130210 | A1 | 6/2006 | Gait | | |
| 2007/0118964 | A1 | 5/2007 | Sacco | | |
| 2012/0047630 | A1 * | 3/2012 | Gare | A41D 27/08 | 2/244 |
| 2012/0185996 | A1 | 7/2012 | Goldberg | | |
| 2012/0222331 | A1 * | 9/2012 | Blunden | A43B 23/24 | 36/102 |
| 2012/0272434 | A1 * | 11/2012 | VanNostran | A45C 13/08 | 2/244 |
| 2013/0042391 | A1 * | 2/2013 | Hill | A45C 13/08 | 2/244 |

* cited by examiner

DECORATIVE ORNAMENT REMOVABLY AFFIXED TO WEARING APPAREL

BACKGROUND OF THE INVENTION

1. Field of the Invention

The present invention relates to the field of ornamentation worn by people to enhance and complement what they are wearing. In particular, the present invention relates to the field of interchangeable jewelry incorporated into wearing apparel, especially gloves, to enhance and compliment the glove as a fashion accessory.

2. Description of the Prior Art

The following 11 patents and published patent applications are the closest prior art known to the inventor.

1. U.S. Pat. No. 1,949,755 issued to John A. Mitchell on Mar. 6, 1934 for "Glove Ornament" (hereafter the "Mitchell Patent");

2. U.S. Pat. No. 4,519,781 issued to Jeannette D. Boyd on May 28, 1985 for "Teaching Tool" (hereafter the "Boyd Patent");

3. U.S. Pat. No. 4,847,917 issued to Murray Strongwater on Jul. 18, 1989 for "Glove Construction With Means for Removably Securing Accessories" (hereafter the "Strongwater Patent");

4. U.S. Pat. No. 5,136,726 issued to Elizabeth Kellin et al. on Aug. 11, 1992 for "Stretchable Articles of Apparel with Detachable Decorative Elements" (hereafter the "Kellin Patent");

5. U.S. Pat. No. 5,933,867 issued to Donald E. Corder on Aug. 10, 1999 for "Promotional Item Having Decorative Emblem and Method of Making Same" (hereafter the "Corder Patent");

6. United States Published Patent Application No. 2006/0130210 to Paul Gait on Jun. 22, 2006 for "Glove with Interchangeable Padding" (hereafter the "Gait Published Patent Application");

7. United States Published Patent Application No. 2007/0118964 to Lisa R. Sacco et al. on May 31, 2007 for "Glove Having an Attached Item of Jewelry" (hereafter the "Sacco Published Patent Application");

8. U.S. Pat. No. 8,062,087 issued to Devyn Davis et al. on Nov. 22, 2011 for "Glove with Attached Doll" (hereafter the "Davis Patent");

9. United States Published Patent Application No. 2012/0185996 to Lizabeth K. Goldberg et al. on Jul. 26, 2012 for "Golf Accessory Accenting System" (hereafter the "Goldberg Published Patent Application");

10. UK Patent No. 223,429 issued to William George Heard on Oct. 23, 1924 for "Improvements in and Relating to Gloves" (hereafter the "Heard UK Patent");

11. Japanese Patent No. JP09316714A issued to Hideo Hayakawa on Dec. 9, 1997 for "Glove" (hereafter the "Hayakawa Japanese Patent").

The Mitchell Patent discloses:

> "As stated, my invention comprises a glove having fingers 18, a ring top 14, or other ornament and means 16 to secure preferably detachably said ring top or other ornament to the glove finger 18."

In this device they claim to have a female fastener member secured to the glove which is best depicted in FIG. 11 showing two openings 64 by which it is inserted through the glove. It appears that the way this system works is the male of the ring is inserted and grasped by the ends of the female fastener. However, referring to the patent text, the patent states:

> "A separable fastener usually includes a pointed male member which is adapted to slide or slip into and be retained in position by a female member. In the embodiments shown, the male member 26 may be attached to the ring top and the female member 28 may be attached to the glove or vice versa."

This patent involves 1932 technology and there is room far improvement to be certain that the ornament is securely retained on the glove finger and to provide a secure retention mechanism to prevent the ornament from falling off the glove if the wearer accidentally bumps the glove and ornament against a surface such as a structure, vehicle, etc. or placing the wearer's hand in a coat or pant pocket.

The Boyd Patent is a variation by having various members slide onto the hand or on a glove with different information such as numbers or letters to be used as a teaching tool.

The Strongwater Patent discloses a glove with means for removably securing accessories. The abstract reads as follows:

> "A glove adapted to have releasably secured thereto an ornamental accessory. There is provided fastener means having a pair of complementary fastener portions adapted to be selectively engagable or disengagable for securing or releasing said fastener portion, respectively. One of said fastener portions is secured to the inside of said glove and the other of said fastener portions is adapted to be secured to said ornamental accessory. In this way any selected one of a plurality of ornamental accessories provided with said other of said fastener portions is adapted to be releasably secured to the glove to form a glove and accessory combination which simulates a glove having an accessory permanently secured thereto by stitching."

Here the ornament is a snap fastener as shown on the body of the glove as shown in FIG. 1 and this is what the limitation is in the claims but it is a variation to show a different way of placing ornaments on a glove. In addition, because the female snap fastener is within the glove, it is less secure than having the mating snap fastener resting above the glove which is a far more secure method to retain an ornament and prevent it from falling off if the ornament is bumped against a surface or a person places the glove in a pant or pocket where the ornament can be pulled off if it is simply in the snap fastener method as shown in Strongwater where the female is embedded within the glove and not extending above the surface of the glove.

The Kellin Patent discloses stretchable articles of apparel with detachable decorative elements. The patent discloses:

> "An article of apparel having one or more detachable decorative elements replaceably coupled thereto, the article of apparel having substantially all exposed cloth surfaces made of a stretchable material having a multiplicity of loop elements, the detachable decorative elements having a multiplicity of hook elements engaging the loop elements of the material."

Claim 1 reads as follows:

> "In combination, an article of clothing and at least one detachable decorative element, said article of clothing having substantially all exposed cloth surfaces made of a flexible material having a multiplicity of loop elements, said detachable decorative elements having a multiplicity of hook elements engaging said loop elements of said article of clothing for random positioning of said at least one detachable decorative element anywhere on said article of clothing."

Essentially this discloses different elements affixed to different locations on garments but does not specifically claim gloves.

The Corder Patent discloses promotional items having decorative emblem and method of making same. The patent discloses having a mounting mechanism which is attachably affixed to the glove primarily on the back of the hand but not on the fingers. Claim 1 of the patent reads as follows:

"A glove bearing a decorative emblem, said glove comprising:

a glove;

a mount having a recessed portion formed therein, said mount being attached to said glove; and a decorative emblem including an emblem printed on a substrate having a top surface and a rear surface, said decorative emblem being coated with a polymer coating on said top surface and coated with an adhesive on said rear surface, said polymer coating protecting said decorative emblem from water damage and scratching said decorative emblem being positioned in said recessed portion of said mount, whereby said glove bears a decorative emblem which is durable and capable of withstanding harsh weather conditions."

The Gait Published Patent Application discloses gloves with interchangeable padding.

The Sacco Published Patent Application discloses a glove having an attached item of jewelry. The drawings are almost impossible to see. The abstract of the patent application reads as follows:

"A glove having a hand portion defining a top side opposite a wearer's palm and a bottom side covering a wearer's palm and a plurality of fingers defining a top side covering the surface opposite the gripping surface of a wearer's fingers and bottom side covering the gripping surface of a wearer's fingers, defining a lower portion adjacent the wearer's wrist and also defining a slit in the lower portion of the glove to allow a wearer to insert the wearer's hand into the glove, the glove further having at least one element of style selected from a group consisting of a bow attached to a top side of a lower portion of the glove, a bracelet attached to opposite sides of the slit such that slit may be opened to accommodate the wearer's hand without removal of the bracelet and a ring attached a topside of a finger of the glove but does not extend to the bottom side of the finger of the glove such that it will not interfere with the wearer's grip."

Here the decorative element is attached to the back of the hand portion or the portion that goes to a person's wrist.

The Davis Patent discloses a glove with an attachable doll. The relevant portion is found in Column 2 Lines 53 through 60 which state:

"The glove can be coupled to the doll using different types of couplers. Example couplings include stitching, magnets, straps, hook-and-loop fasteners, or other types of couplings that allow for a user to directly attach the doll appendages to the exterior surface of the glove and allow for easier detachment. In some embodiments, reusable adhesives can also be used. a coupling that allows a user to separate the glove from the doll."

Claim 1 reads as follows:

"An article of manufacture for use with a human hand, comprising: a glove having a hand-receiving cavity from which extends at least one finger-receiving cavity; and a doll having a body and a plurality of independently moveable appendages, the doll physically distinct from and disposed externally to the glove; and wherein at least some of the appendages have a connecting mechanism to removeably and directly attach to an exterior surface of the glove and where the body lacks a connecting mechanism to directly attach to the exterior surface of the glove."

The Goldberg Published Patent Application It discloses a golf accessory accenting system. Specifically, the patent application discloses:

"A golf accessory accenting system utilizes one or more accent groups to coordinate golf accessories with a user's outfit. Each accent group include a plurality of replaceable accent pieces that may be coordinated for use on or with one or more golf accessory, including a golf hat (such as a golf visor or a baseball cap), a golf glove, a belt, golf shoes, a golf bag, a golf towel, one or more equipment storage bags, and the like, to accent, customize and coordinate a golfer's outfit and full ensemble based on color, pattern, style, texture, or the like. Accent pieces may be swatches, strips or bands of ribbon or fabric cut and sized to be added to a golf accessory as an accent of color, style or texture, and removably fastened thereto by means of fasteners so that they can be easily removed, replaced, and mixed-and-matched as desired."

The Heard UK Patent discloses the following:

"The object of this invention is to provide a simple and effective method of attaching decorative ornaments to the exterior of the glove so as to produce a novel design which will be most effective in appearance.

According to this invention, decorative pieces of leather, suede, fabric or the like are cut or formed to the required shape so as to represent a flower, leaf, rosette or the like. This flower, leaf, rosette or the like is preferably formed of material similar to the glove to which it is to be attached but of a lighter or darker color, or for use on suede gloves, soft kid or the like may be employed or vice versa. The flower, leaf, rosette or the like is attached to the glove by means of one or more suitable clips, preferably of the snap button type, the outer button portion of which serves as part of the decorative ornament, such as the flower centre, whilst the inner portion passes through the flower, leaf, rosette or the like and engages in the button so as to readily secure the whole in position."

The Hayakawa Japanese Patent discloses a glove. The English abstract states:

"PROBLEM TO BE SOLVED: To obtain gloves that match the worn dress and are adorned with artificial flowers, ribbons, etc., depending on choice of the person who wears the gloves, and can be simply put on without much trouble.

SOLUTION: This type of gloves comprises one of paired surface fasteners which is fixed on the outside surface of a cloth 3 of a glove that comes in contact with the back of the hand when worn on the hand, and the other paired hook and loop fasteners 5b fixed on the back faces of accessories 2a, 2b formed of artificial flowers, ribbons, etc., so as to be detachably fitted to the outside surface of the cloth 3 by attaching the fasteners 5b to the paired fastener 5a. If the glove 1 does not match the dress, the accessories 2a, 2b on the glove can be simply removed by pulling the accessories 2a, 2b off the cloth 3 of the glove without taking the glove off, and replaced with other accessories because the accessories 2a, 2b are simply fixed with hook and loop fasteners 5a, 5b only."

As discussed, the prior art essentially has retention mechanisms that are not strong and that enable the ornament to be easily knocked off.

There is a significant need for an improved mechanism by which an ornament is retained onto one or more finger sections of a glove to provide a secure retention mechanism as well as provide ornamental beauty and enhancement to the glove.

SUMMARY OF THE INVENTION

The present invention is an apparatus which provides a removable affixation member affixed into gloves, preferably permanently affixed to gloves, so that the affixation member which is primarily male will extend out of the outside surface of the glove. The attachment mechanism affixed to at least one finger portion of a glove is selected from the group consisting of a threaded male member extending outwardly from the surface of the glove onto which a threaded female member from an ornament is threadedly attached, a twist lock male member extending outwardly from the surface of the glove onto which a locking female member from the ornament is attached, a male clip receiving member extending from a finger portion of the glove with an attaching clip member affixed thereto, either a hook or loop fastener on a finger portion of a glove with a matching hook or loop fastener extending from the ornament, a magnet extending from a surface of a finger portion of a glove and a mating magnet extending from the ornament, a male button snap member extending from a surface of a finger portion of a glove and a mating button snap members extending from the ornament.

While a male member extending from the glove to a mating female member on the ornament is preferred as it is believed this combination will provide more retention security to the ornament on a finger portion of the glove, the reverse of a female attachment member on a finger portion of the glove and a mating male member on the ornament is also within the spirit and scope of the present invention.

In addition, the attachment mechanism can be a round headed pin or a straight pin on the finger portion of the glove. On the other side, there is a decorative accessory such as a jewelry item with a bottom member that is affixed onto the attaching member on the gloves which jewelry item would have a female receiving member which would include a female to receive the mating fastener.

It is an object of the present invention to have at least one decorative jewelry item on one glove finger or several fingers of gloves, both on the left hand and right hand. The jewelry item could be very simple or it could be very fancy. The same concept can be incorporated into wearing apparel such as hats, lapels, etc.

The present invention is differentiated from the prior art design where a pin from the decoration sticks through the garment with a fastening member on the back. It is a further object of the present invention to have the fastening member incorporated into the garment primarily on the glove so that it sticks outside the glove and does not come in contact with a person's finger inside the glove finger portion and then having the decorative item as a female member which is received and retained by the fastening member by a removable mechanism as described above.

It is also within the spirit and scope of the present invention to have the decorative item permanently affixed to the finger portion of a glove.

In the fashion industry and in the fashion glove category, the use of costly and highly elaborate removable/interchangeable ornaments is not possible due to the inadequate means of affixing these ornaments to gloves. The present invention creates the possibility of an entirely new line/category of fashion gloves that not only provide for interchangeable ornaments that are more secure, but also create the opportunity to introduce more expensive and exclusive products to the market.

It is an intention of the inventor to fulfill a need in the marketplace for gloves for children and teenagers as well as adults to allow for interchangeable, highly customizable adornments. The key innovation is that the way the ornaments are secured by having the protruding post section from the mating section of the glove which is secured by the transverse member retained within the lining helps secure the mating member so that it more securely grips the ornament and assures that it will not fall off if the ornament is accidentally bumped against a surface or alternatively, if a person puts their hand or their gloved hand in their pocket with creating friction against the ornament which would cause the ornament to fall off.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF EMBODIMENTS OF THE PRESENT INVENTION

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
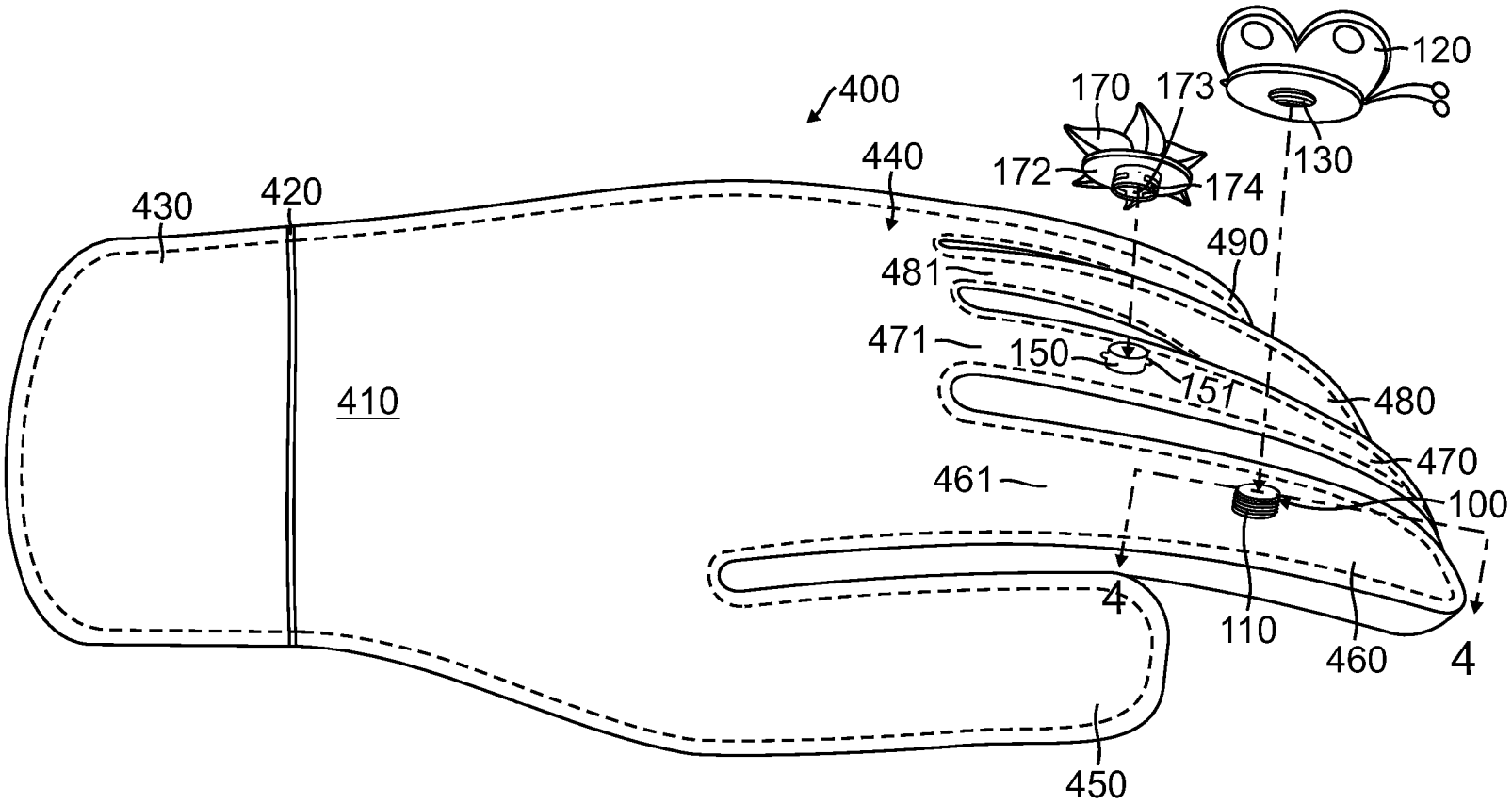
FIG. 1 is an exploded top perspective view of a glove illustrating a male threaded screw protruding from an index finger portion of a glove and a mating female threaded member incorporated into an ornament, and a first portion of a twist lock mechanism protruding from a fourth finger portion of a glove and a mating twist lock mechanism incorporated into an ornament.

Referring to FIG. 1, there is illustrated a glove 400 which is a left handed glove. The glove 400 includes a body 410 which covers the back of a wearer's hand and terminates at an interior end 420 in a wrist covering section 430. At the exterior end 440, the glove has five fingers, a thumb 450, an index or forefinger 460, a middle finger 470, a fourth or ring finger 480 and a pinkie 490. It will be appreciated that a right handed glove is a mirror image of the left handed glove 400 and its components as described. The glove 400 can be made of any material but preferably is selected from the group consisting of wool, cashmere and knit. The glove 400 is intended to be used with a fashion accessory.

Figure 4:
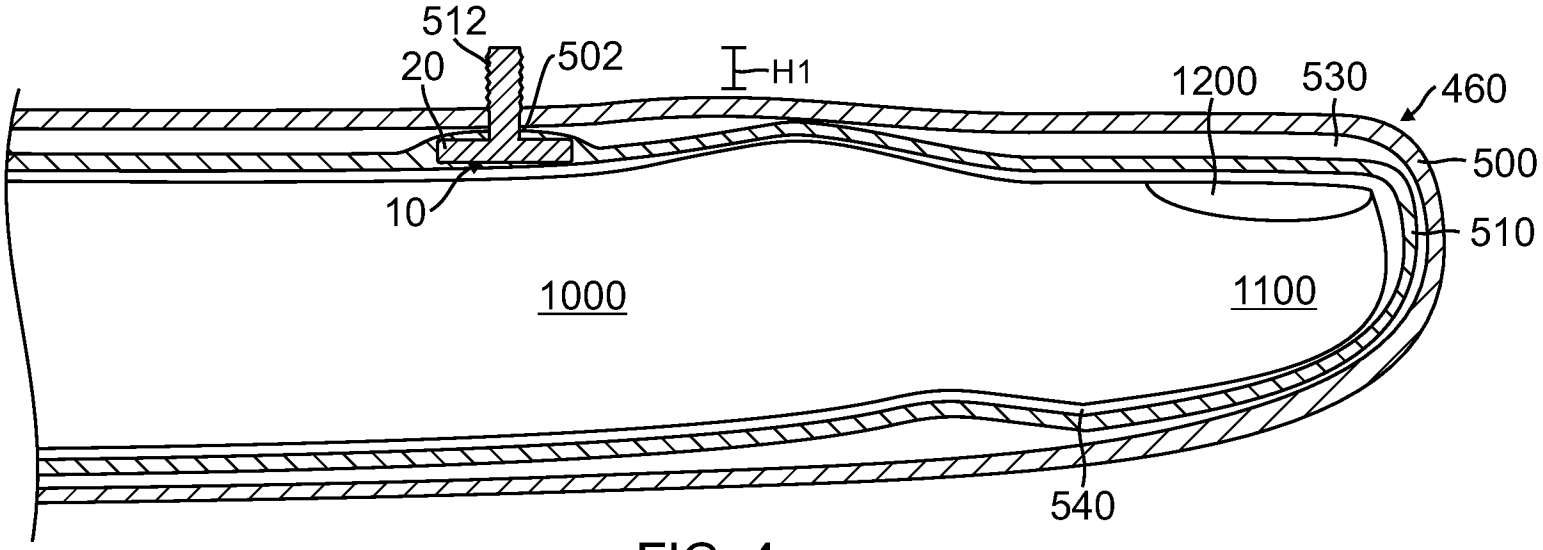
FIG. 4 is a cross-sectional view taken along line 4-4 of FIG. 1.

The glove 400 is intended to be used as a fashion accessory and therefore is primarily intended for use by women and girls although it is within the spirit and scope of the present invention for the glove to be used by men and boys. A respective finger of a hand including the thumb, forefinger, middle finger, fourth finger and pinkie finger is inserted into a respective glove finger which respectively retains a thumb, forefinger, middle finger, fourth finger and pinkie finger. Referring to the cross-sectional view of FIG. 4, an index finger 1000 having a tip 1100 and a nail 1200 is inserted into the interior chamber 540 of glove index finger member 460. The glove index finger member 460 has an exterior surface 500 and an interior lining surface 510 separated by a gap 530.

A key innovation of the present invention is to have a glove mating fastening member 10 which includes a transverse retaining section 20 which is embedded into or otherwise affixed into the lining 510 of the glove section, the glove mating fastening member 10 also including a glove mating fastener 512 formed as part of the retaining section 20. The glove mating fastener 512 extends transverse to the retaining section 20 and extends through the lining 510 and through the exterior surface 500 and extends for a given height H1 above the exterior surface 500 of the at least one glove section 460, the retaining section 20 preventing the glove mating fastener 512 from being pulled out of or knocked out of at least one glove finger section.

Also, as illustrated in the various other figures, as best illustrated in FIG. 1, an ornament such as 170 has affixed to the ornament an ornament mating fastener 174. As illustrated in FIG. 1, the ornament mating fastener 174 can extend from the bottom 172 of the ornament or alternatively, in the butterfly design, where the ornament is 120, the ornament mating fastener 130 can be embedded into the ornament.

The ornament mating fastener such as 174 or 130 is removably affixed to the glove mating fastener 512 so that the ornament such as 170 is visible and rests on the exterior surface such as 500 (see FIG. 4) of the glove finger section 460 so that the ornament 170 is visible on at least one glove finger section and the glove mating fastener 512 and the ornament mating fastener 174 are concealed so that it is not visible. Examples of various embodiments of the present invention will now be discussed.

A key innovation of the present invention is to have a glove mating fastening member which includes a retaining member, in this case mating female threaded member 10 sewn or otherwise permanently affixed into to lining 510 or other interior portion of the glove forefinger section 460. By way of example, the mating retaining member 10 has a transverse section 20 which facilitates the mating retaining member 10 being embedded into the interior of the glove index finger 460 so that the mating retaining member 10 can't be pulled out or knocked out. The interior lining 510 has a small opening 502 aligned with a small opening 503 in the exterior surface 500 to enable a glove mating fastener 512 to extend through openings 502 and 503 and extend out from exterior surface 500 for a given height "H1". It will be appreciated that for each attaching member combination within a finger member of the glove 400 and embedded into or extending out of an ornament, the glove finger section has a portion of a mating retaining member embedded within the glove finger section comparable to the way the mating retaining member 20 is sewn into or otherwise embedded within the glove finger 460 such as into lining 510.

In summary, the invention comprises a first mating fastening member embedded within a finger member of a glove so that a glove mating portion extends out of an exterior surface of a glove finger member and a mating ornament fastening member is either embodied into or extends out of a bottom of the ornament so that the ornament mating member is removably affixed tot the glove mating portion to retain the ornament onto the glove finger member so that the ornament retention mechanism including the combination glove mating portion and ornament mating portion is concealed.

FIG. 1 illustrates two variations of the present invention. Specifically, referring to FIG. 1, on the forefinger portion of the glove 460 there is a mating male threaded screw protruding from the index finger portion of the glove. The mating male index finger threaded portion can have a transverse section 20 comparable to that illustrated in FIG. 4 and the threaded post section extending out of the upper surface of the glove. Specifically, the male threaded section post is numbered 100 and has thereon threads 110. This is one example of a glove mating portion which is a male fastening member affixed into the glove 410. There is a decorative ornament such as a butterfly 120 and the butterfly has built into it a mating ornament fastening member having female mating set of threads 130. The female mating set threads 130 is threaded onto the male set of threads 110 of the protruding column 100 so that the butterfly ornament is securely fastened to the top surface 481 of index finger or forefinger section 480 of the glove 400.

Another variation of the mating fastening member is a twist locking mechanism 150 which is retained within the interior of a third finger section 470 as illustrated in FIG. 1 with a first fastening member 150 protruding from the third finger portion 470 of the glove 400. An ornament which is a star 170 has extending from its bottom surface 172 a mating fastening member 174 which is a mating twist lock mechanism. The mating ornament twist lock mechanism 174 is affixed to the glove mating twist lock mechanism 150 so that the ornament 170 is securely retained onto the third portion 470 of the glove 400.

Figure 2:
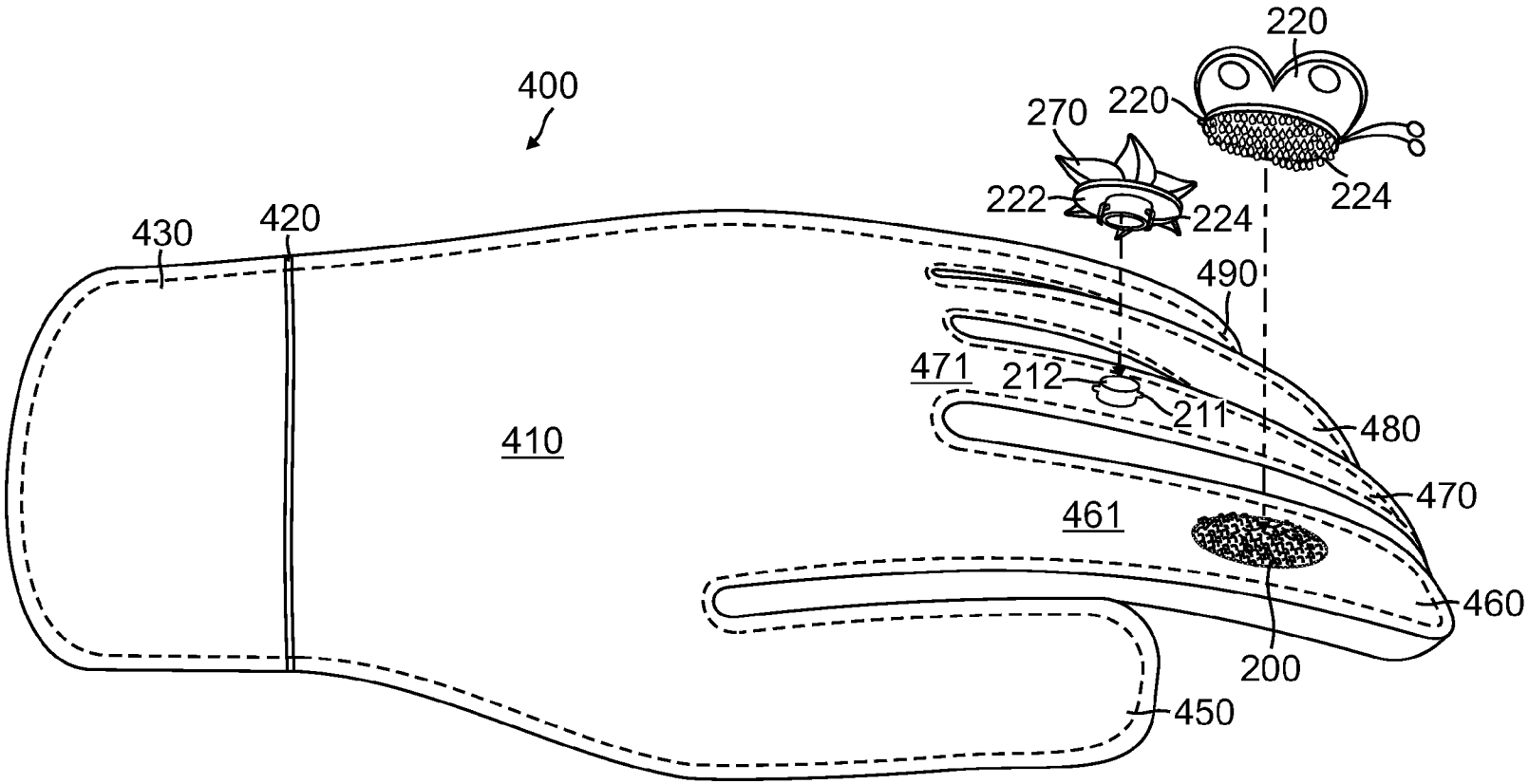
FIG. 2 is an exploded top perspective view of a glove illustrating a mating hook or loop fastener on a surface of an index finger portion of a glove and a mating hook or loop fastener incorporated into an ornament, and a mating clip member mechanism extending from the surface of a fourth finger of a glove and a mating clip member mechanism incorporated into an ornament.

Referring to FIG. 2, there are two additional variations on the mating fastening members. Referring to the forefinger portion 460, and its upper surface 461, there is a first glove mating fastening member 200 is a hook-and-loop fastener affixed onto the index finger section 460 and protrudes from the exterior surface 461. A butterfly ornament 220 has an incorporated into its bottom surface 222 an ornament mating hook-and-loop fastening member 224 which mates with the hook or loop fastening member 200 so that the ornament 220 is securely affixed to the index finger portion 460 of the glove 400.

Also referring to FIG. 2, there is a first fastening member protruding from the middle finger portion 470 extending through the upper surface 471 and the glove fastening portion is a mating clip member 212. The flower ornament 270 has a bottom surface 222 which has on there an ornament mating fastening member 224 protruding from the bottom. The mating fastening member 224 is a mating clip which mates with the mating clip portion 212 extending from the upper surface 471 of middle finger 470 and therefore the ornament is securely retained in this manner.

Figure 3:
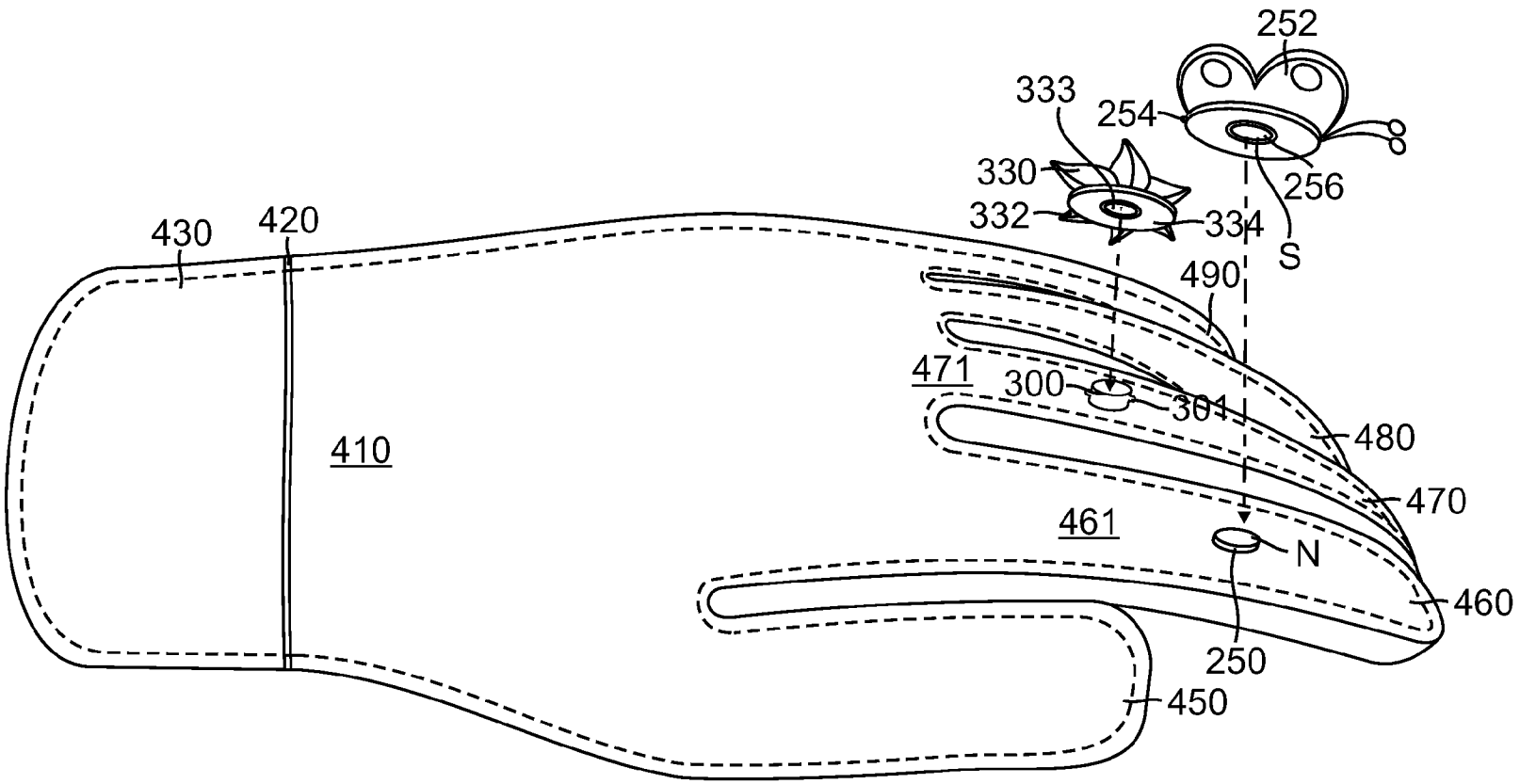
FIG. 3 is an exploded top perspective view of a glove illustrating a mating magnet extending from an index finger of a glove and a mating magnet incorporated into an ornament, and a button snap mechanism extending from a middle finger of a glove and a mating button snap member incorporated into a bottom of an ornament.

Referring to FIG. 3, there is illustrated another pair of mating fastening members to illustrate the principles of the present invention. Referring to FIG. 3, the forefinger portion 461 having its upper surface 460 has retained within the forefinger portion a glove mating fastener which is a mating magnet 250. The ornament which is a butterfly which is numbered 252 has a bottom surface 254 which has an ornament mating magnet member 256 extending from its bottom surface. Therefore, glove mating magnet 250 and the ornament mating fastening member mating magnet 256 are retained together to create a third mating fastening member.

A sixth example is a button snap mechanism which extends from the middle finger portion 470 of the glove 460. The mating fastening member is a glove mating button 300 and the ornament which is a flower 330 has a bottom surface 332 which has embedded within it a second mating button fastening member 334 which mates with the protruding button fastening member 300 to securely retain the ornament 252 to the middle finger portion 471.

It is understood that these are just representative examples of mating fastening members which contain an ornament onto the glove where the mating fastening member portion of the glove is embedded within the interior surface of the glove so that it is securely retained through any affixation means including but not limited to sewing, adhesive members, etc. The mating fastening members enable the ornament to be securely retained to fit any finger portion of the glove so that it will not be knocked off.

Figure 5:
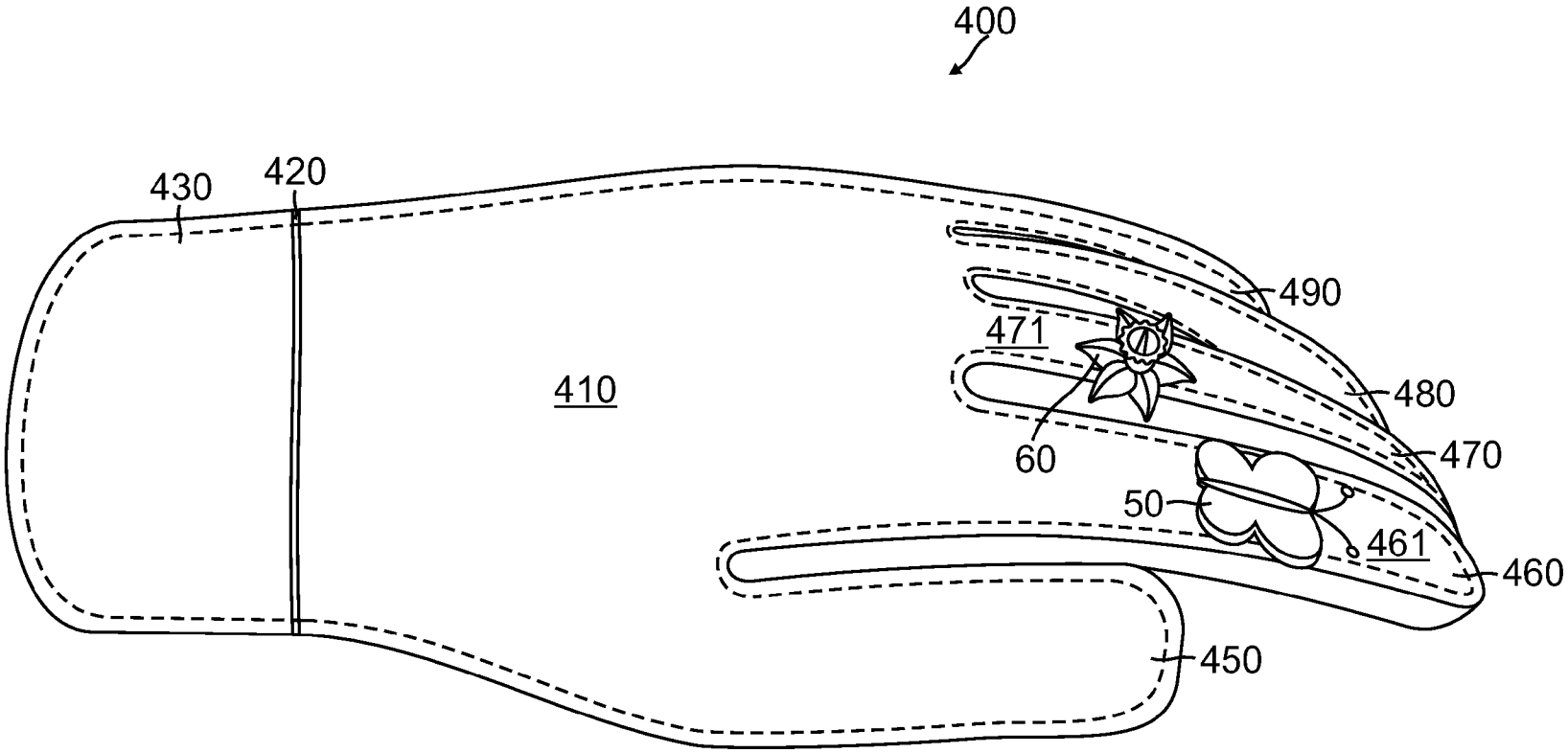
FIG. 5 is a top perspective view of a glove illustrating a first ornament which is a ladybug affixed onto the index finger of a glove and a second ornament which s a flower affixed onto a fourth finger of a glove.

Examples of the retention are illustrated in FIG. 5. The butterfly 50 is affixed to the upper surface 461 of index finger 460 portion of the glove 400. The flower 60 is affixed to the surface 471 of middle finger section 470. It will be appreciated that any one of the ornaments can be any shape with any of the random mating fastening members which have already been discussed and the use of the ornament can be any desired ornament and is not limited to a butterfly or a flower but can be any type of decorative ornament of any kind including just a random artwork, any type of insect, any type of animal, any type of reptile, any type of amphibian, any type of fish, any type of bird, any type of celestial body, or any other decorative artwork which forms the attractive attaching member.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. An apparatus in combination with a glove worn on a wearer's hand having a thumb, index finger, middle finger, fourth finger and pinkie, the glove having five finger sections including a glove thumb section into which the wearer's thumb is inserted, a glove index finger section into which the wearer's index finger is inserted, a glove middle finger section into which the wearer's middle finger is inserted, a glove fourth finger section into which the wearer's fourth finger is inserted, and a glove pinkie section into which the wearer's pinkie is inserted, each finger section having an exterior surface and an interior lining which separates an interior surface of the glove from the exterior surface of the glove, a wearer's finger inserted into a respective glove finger section, the apparatus comprising:

a. a glove mating fastening member including a retaining section embedded into and affixed into a respective interior of a respective interior lining and a respective glove mating fastener formed as part of the retaining section, the glove mating fastener extending transverse to the retaining section and extending through the lining and through the exterior surface and extending for a given height above the exterior surface of the glove finger section selected from the group consisting of the glove index finger section, the glove middle finger section, the glove fourth finger section and the glove pinkie section, the retaining section preventing the glove mating fastener from being pulled out of or knocked out of the respective glove finger section;

b. an ornament affixed to an ornament mating fastener; and c. the ornament mating fastener removably affixed to the glove mating fastener so that the ornament is visible and rests on the exterior surface of respective glove finger section so that the ornament is visible on the respective glove finger section and the glove mating fastener and the ornament mating fastener are concealed.

2. The apparatus in combination with a glove in accordance with claim 1, further comprising: the retaining section embedded within the lining prevents the glove mating fastener member from coming in contact with a finger inserted into the respective glove finger section.

3. The apparatus in combination with a glove in accordance with claim 1, further comprising: the ornament mating fastener is embedded into the ornament.

4. The apparatus in combination with a glove in accordance with claim 1, further comprising: the ornament mating fastener extends outwardly from a bottom section of the ornament.

5. The apparatus in combination with a glove in accordance with claim 1, further comprising:

a. the glove mating fastener is a male threaded screw protruding from the respective glove finger section; and b. the ornament mating fastener is mating threads which are threaded onto the mating male thread of the glove mating fastener.

6. The apparatus in combination with a glove in accordance with claim 1, further comprising:

a. the glove mating fastener is a twist lock mechanism; and b. the ornament mating fastener is a mating twist lock mechanism which twists and locks onto the twist lock mechanism of the glove mating fastener.

7. The apparatus in combination with a glove in accordance with claim 1, further comprising:

a. the glove mating fastener is a magnet; and b. the ornament mating fastener is a magnet which is an opposite polarity to the magnet on the glove mating fastener so that the ornament mating fastener is retained by the glove mating fastener.

8. The apparatus in combination with a glove in accordance with claim 1, further comprising:

a. the glove mating fastener is a button snap mechanism; and b. the ornament mating fastener is a mating button snap mechanism which is retained by the button snap mechanism of the glove mating fastener.

9. An apparatus in combination with a glove worn on a wearer's hand, the wearer's hand having at least one finger and the glove having at least one finger section into which the at least one finger is inserted, the at least one finger section of the glove having an exterior surface and an interior lining which separates an interior surface of the at least one finger section of the glove from the exterior surface of the at least one finger section of the glove, the apparatus comprising:

a. a glove mating fastening member including a retaining section embedded into and affixed into the lining of the at least one finger section of the glove, and a glove mating fastener formed as part of the retaining section, the glove mating fastener extending transverse to the retaining section and extending through the lining and through the exterior surface and extending for a given height above the exterior surface of the at least one finger section of the glove, the retaining section preventing the glove mating fastener from being pulled out of or knocked out of the at least one finger section of the glove;

b. an ornament affixed to an ornament mating fastener; and c. the ornament mating fastener removably affixed to the glove mating fastener so that the ornament is visible and rests on the exterior surface of the at least one finger section of the glove so that the ornament is visible on the at least one finger section and the glove mating fastener and the ornament mating fastener are concealed.

10. The apparatus in combination with a glove in accordance with claim 9, further comprising: the retaining section embedded within the lining prevents the glove mating fastener member from coming in contact with a finger inserted into the at least one finger section of the glove.

11. The apparatus in combination with a glove in accordance with claim 9, further comprising: the ornament mating fastener is embedded into the ornament.

12. The apparatus in combination with a glove in accordance with claim 9, further comprising: the ornament mating fastener extends outwardly from a bottom section of the ornament.

13. The apparatus in combination with a glove in accordance with claim 9, further comprising:

a. the glove mating fastener is a male threaded screw protruding from the at least one finger section of the glove; and b. the ornament mating fastener is mating threads which are threaded onto the mating male thread of the glove mating fastener.

14. The apparatus in combination with a glove in accordance with claim 9, further comprising:

a. the glove mating fastener is a twist lock mechanism; and b. the ornament mating fastener is a mating twist lock mechanism which twists and locks onto the twist lock mechanism of the glove mating fastener.

15. The apparatus in combination with a glove in accordance with claim 9, further comprising:

a. the glove mating fastener is a magnet; and b. the ornament mating fastener is a magnet which is an opposite polarity to the magnet on the glove mating fastener so that the ornament mating fastener is retained by the glove mating fastener.

16. The apparatus in combination with a glove in accordance with claim 9, further comprising:

a. the glove mating fastener is a button snap mechanism; and b. the ornament mating fastener is a mating button snap mechanism which is retained by the button snap mechanism of the glove mating fastener.

* * * * *